United States Patent [19]

Krishna et al.

[11] Patent Number: 4,511,474

[45] Date of Patent: Apr. 16, 1985

[54] CYCLONE SEPARATOR HAVING BOUNDARY LAYER TURBULENCE CONTROL

[75] Inventors: Coimbatore R. Krishna, Mt. Sinai; Julius S. Milau, Port Jefferson, both of N.Y.

[73] Assignee: The United States of America as represented by the United States Department of Energy, Washington, D.C.

[21] Appl. No.: 574,782

[22] Filed: Jan. 27, 1984

[51] Int. Cl.[3] ..... B04C 3/06

[52] U.S. Cl. ..... 210/512.1; 55/392; 55/424

[58] Field of Search ..... 210/787, 788, 789, 512.1, 210/512.2, 512.3; 55/52, 203, 204, 459 R, 392, 423, 424; 209/211, 144

[56] References Cited

U.S. PATENT DOCUMENTS

| | | | |
|---|---|---|---|
| 1,057,613 | 4/1913 | Baldwin . | |
| 1,292,561 | 1/1919 | Baldwin . | |
| 2,453,593 | 11/1948 | Putney . | |
| 2,816,490 | 12/1957 | Boadway et al. | 209/211 |
| 3,454,163 | 7/1969 | Read | 210/512.1 |
| 3,486,314 | 12/1969 | Herrington | 55/408 |
| 3,616,911 | 11/1971 | Rodriguez | 209/211 |
| 3,687,286 | 8/1972 | Weiss | 209/211 |
| 3,768,658 | 10/1973 | Palma | 210/512.1 |
| 4,140,632 | 2/1979 | Boivin | 210/788 |
| 4,226,369 | 10/1980 | Botts et al. . | |
| 4,231,771 | 11/1980 | Wirshe | 55/459 R |
| 4,399,027 | 8/1983 | Miller | 209/211 |
| 4,407,205 | 10/1983 | Beaufrere | 110/264 |

OTHER PUBLICATIONS

Giles et al., "Laminar Flow Cyclone Development Program", Contract No. FE-3242-2, General Electric Company, Jan. 1979.

Giles et al., "Laminar Flow Cyclone Development Program", Contract No. FE-3242-5, General Electric Company, Apr. 1979.

Energy Systems Programs Dept., General Electric, "PFB Coal Fired Combined Cycle Dev. Program", Con. No. FE-2357-39, Feb. 1980.

*Primary Examiner*—Barry S. Richman
*Assistant Examiner*—John Donofrio
*Attorney, Agent, or Firm*—Jeannette M. Walder; Vale P. Myles; Judson R. Hightower

[57] ABSTRACT

A cyclone separator including boundary layer turbulence control that is operable to prevent undue build-up of particulate material at selected critical areas on the separator walls, by selectively varying the fluid pressure at those areas to maintain the momentum of the vortex, thereby preventing particulate material from inducing turbulence in the boundary layer of the vortical fluid flow through the separator.

14 Claims, 1 Drawing Figure

CYCLONE SEPARATOR HAVING BOUNDARY LAYER TURBULENCE CONTROL

The United States Government has rights in this invention persuant to Contract Number DE-ACO2-76CH00016, between the United States Department of Energy and Associated Universities, Inc.

BACKGROUND OF THE INVENTION

The invention relates to improved cyclone separators for removing particulate material from fluids including a wide variety of liquids, gases, and more particularly, relates to improvements in such separators for controlling boundary layer turbulence in the vortex flow of fluid therethrough in order to prevent particulate material from inducing turbulence in the boundary layer and causing reentrainment of particulate material in the vortex flow. The basic principles common to most cyclone separators have been known and used for years. Such separators have been successfully used to purify both liquids and gases by separating entrained particulate matter from them. In addition, cyclone separators have been used to separate both liquids of differing viscosity, and entrained particles of differing sizes, from one another. For example, such devices are useful to separate cream from milk, entrained water from steam, as well as to separate dust from air supplies and smoke from the discharge gases in chimney flues.

In general, cyclone separators operate by subjecting a flow of fluid and entrained particles passing through the separator to a combination of forces that are effective to drive most of the particules to an area of the separator where the particles can be readily extracted from the fluid flow. Typically, a cyclone separator includes a generally cylindrical chamber for receiving inlet fluids, and a frusto-conical section for establishing a vortex flow of the fluid toward the truncated apex end of the conical section. Fluid is introduced under high pressure tangentially into the upper end of the cylindrical chamber and flows helically into the frusto-conical section which establishes a vortex flow in the fluid to increase the centrifugal forces and angular velocity gradient applied to the fluid flow and the entrained particles. In addition to those forces, a pressure differential exists in the separator from the inlet end toward the outlet end thereof as well as from the periphery of the cylindrical chamber and frusto-conical section toward the central longitudinal axis of the separator.

The centrifugal force exerted by the toroidal flow of the fluid passing through the separator acts to propel the heavier matter in the fluid flow toward the circumference of the separator walls. Further complex forces operate to separate heavier particles from the fluid flow passing through such separators. Normally, the longitudinal axis of a cyclone separator is veritically oriented so that the force of gravity is effective to more heavy particles in the vortex fluid flow toward the outlet of the separator at the truncated end of its frusto-conical section. There also exists an hydraulic drag force or effect on particles in the vortex flow through cyclone separators. This hydraulic drag effect is most pronounced on particles having relatively long bodies that subject different areas of the particles simultaneously to the friction force of the relatively slower velocity fluid near the center of the cyclone separator, while the outer end of the particles are subjected to another friction force exerted by faster moving fluid nearer the periphery of the vortex flow. Such hydraulic drag effects cause longer particles in the fluid flow to tend to move radially inward toward the longitudinal axis of the separator.

In addition to these complex forces present in cyclone separators, there is always a considerable degree of turbulence present in the vortex flow of fluid through a separator. Such turbulence is normally very counterproductive and frequently causes mixing of pariculate matter with the fluid flow, rather than facilitating separation of particulate matter from the fluid, as in normally desired. Thus, turbulence in the vortex flow of a separator has long been recognized as a disadvantage and various measures have been developed to eliminate or diminish such turbulence. One significant source of turbulence in cyclone separators is the introduction of eddy currents into the flow of liquid entering the separator at high velocity. In general, such eddy current turbulence increases as the velocity of inlet fluids is increased in an effort to improve the separating effect of the centrifugal forces acting in the separator on entrained particles.

Various inlet control structures have been proposed to cope with such fluid flow inlet turbulence, as explained for example in a report prepared for the U.S. Department of Energy under its Contract Number ET-78-C-01-3242. The report is entitled, "Laminar Flow Cyclone Development Program" (Quarterly Technical Progress Report, Oct. 1-Dec. 31, 1978) bearing code number FE-3242-2, and authored by W. B. Giles and K. L. Bekofske. Beyond the inlet flow turbulence created by eddy current effects, other causes of turbulence exist within most cyclone separators. The disadvantageous reentrainment effect of such turbulence is particularly noticeable in reducing the operating efficiency of very high pressure cyclone separators that are used to remove very fine particulate material from fluids. One application of such high pressure separators that has grown extensively in recent years is in the field of coal gasification where very fine particulate matter must be removed from coal gas before it is introduced into a power generating turbine. In such applications it is desirable to remove not only relatively large entrained particulate material from the fluid flow, but to also extract as much of the very fine particulate matter, such as particles of one to ten microns in length, as possible. Fluid bed combustion of coal results in entrainment of a wide range of different sized particles in the exhaust gases, so it is necessary to improve their extraction in order to reduce the erosive and corrosive effects that such particulate material has on the high speed gas turbine blades through which the cyclone-purified gas is passed in a typical co-generation process. One known method for removing particulate, in the range of two to five microns, from a gas stream that is to be fed into a gas turbine is to expose the gas stream to laser illumination in order to destroy the particulate. U.S. Pat. No. 4,226,369-Botts, which issued Oct. 7, 1980, disclosed such a process.

Although the effectiveness of cyclone separators can be improved by increasing the velocity of vortex liquid flow through them, it has been found that in prior art cyclone separators the effectiveness of such high velocities is particularly limited relative to the desired extraction of very fine particulate matter, such as that having dimensions in the one to ten micron range. It has been discovered that in such high velocity separators of prior art design, boundary layer turbulence occurs which causes reentrainment of fine particulate material in the vortex fluid flow. Such reentrainment allows the fine particulate material to move radially inward as the vortex flow approaches the primary collector outlet, thus, the fine particulate matter is not extracted from the particulate collector discharge end of the separator, but rather is entrained in the central vortex flow of liquid that moves upward in the separator to the main fluid discharge outlet. Of course, such reentrainment of particulate matter is disadvantageous and it would be very desirable to prevent the occurrence of reentrainment, if possible, so that the discharge fluid from the separator could be optimumly purified.

U.S. Pat. No. 4,231,771-Winsche, which issued Nov. 4, 1980, discloses the use of an inertial separator having a rotary partition means that divides the separator housing into a plurality of axially-extending passageways arranged in parallel. The separator is operable to remove particulate in the range of five to ten microns in size from combustion gases produced by burning coal, thereby to prepare the gases for introduction to a gas turbine. Although such inertial separators are not directly related to the type of cyclone separator disclosed herein, this prior art patent is representative of the efforts that others have made to develop an economically feasible means of dealing with the problem of removing very fine particulate from high volume gas flows in order to reduce the deleterious effects of such particulate on down-stream apparatus, such as gas turbine blades into which such combustion gases are often fed.

The study of boundary layer turbulence control as applied to the flow of fluids over foil surfaces, such as those used in airplanes, is generally quite well advanced. It has been shown that boundary layer turbulence can cause the formation of bubbles or a separating effect between a laminar flow of fluid and the surface of an air foil past which the fluid is flowing. Such a separation of the laminar flow of fluid from an air foil can collapse the lifting effect that the fluid normally has on the foil, it is necessary to prevent the separation in foil applications, such as those on airplanes, where the lifting effect is necessary to support the plane in flight. Early studies demonstrated that laminar flow of fluid over an air foil can be improved by applying suction pressure to the surface of the foil in those areas where boundary layer separation is most likely to occur. Many different types of suction apparatus have been applied to air foils, including the provision of both widely spaced and closely spaced apertures in the lifting surface of the foils, through which suction pressure is applied. In some tests porous plugs have been used in such suction apertures in foil surfaces to control the direction at which fluid is sucked from the foil surface. In other structures, suction air is first passed through a series of fine slots that are cut into the wing skin surface with a diamond slitting saw or other suitable cutting means, then the suction air is drawn through small grooves under the slits and sent into drilled holes through thicker inner sheeting material of the wing and finally into associated suction duct apparatus.

As far as the present inventors known there is little published research data to explain necessary design requirements for the successful application of boundary layer control means to foil surfaces. More particularly, with respect to the field of the subject invention, the present inventors are unaware of any use of boundary layer turbulence control means being applied to cyclone separators, prior to their invention, for the purpose of improving the separating efficiency of such separators. Moreover, it is not seen that either boundary layer suction or pressure regulating methods for use in controlling air foil lifting effect principles, or the disadvantages inherent in boundary layer flow separation from such air foils, finds any readily apparent application in the construction or use of cyclone separators. Recently issued U.S. Pat. No. 4,407,205-Beaufrere (issued Oct. 4, 1983), discloses a coal combustor/gasifier that includes an inertial separator for removing ash from a combustion chamber. The helical flow of gas through the combustor is improved by boundary layer control means somewhat analogous to those disclosed herein.

OBJECTS OF THE INVENTION

A primary object of the present invention is to provide a cyclone separator that overcomes the above-mentioned disadvantages and shortcomings of related prior art cyclone separators while enabling more efficient separation of very fine particulate material from fluids.

Another object of the invention is to provide a cyclone separator having boundary layer turbulence control means that operate to prevent reentrainment of particulate material in the primary vortical flow of fluid through the separator.

A further object of the invention is to provide a cyclone separator that is effective to remove from a vortex flow of fluid therethrough the majority of particulate material having a size in the range of one to 10 microns.

Yet another object of the invention is to provide a cyclone separator with boundary layer turbulence control means that are operable to maintain the momentum of particulate material in the vortex flow of fluids through the separator, at critical loci spaced along the inner peripherial surface of the separator, thereby to prevent particulate material from inducing turbulence in the boundary layer flow at the critical areas.

A still further object of the invention is to provide a cyclone separator with boundary layer turbulence control means that are operable to prevent the build up of particulate material at predetermined spaced areas of the separator.

Additional objects and advantages of the invention will become apparent from the disclosure of it herein considered in conjunction with the accompanying drawing.

SUMMARY OF THE INVENTION

In a preferred embodiment of the invention a cyclone separator comprising a generally cylindrical hollow body section connected to a frusto-conical vortex-inducing section is characterized by being provided with boundary layer turbulence control means that are operable to prevent particulate matter in the vortex flow of fluid through the separator from moving radially inward, thereby to prevent the particulate material from being reentrained in the relatively purer fluid evacuated along the longitudinal axis of the separator toward the main fluid outlet thereof. The boundary layer control means include a plurality of spaced apertures in the outer wall of the separator to which fluid pressure regulator means are operatively connected for selectively applying predetermined control pressure variations of either a positive or negative sense relative to the pressure of the fluid in the vortex flow through the separator. The applied pressure variations maintain the momentum and laminar characteristics of the boundary layer flow at such locations, thus preventing turbulence in that flow and avoiding consequent reentrainment of particulate matter in the cleansed fluid that is discharged from the main fluid outlet of the separator.

DESCRIPTION OF THE PREFERRED EMBODIMENT

Figure 1:
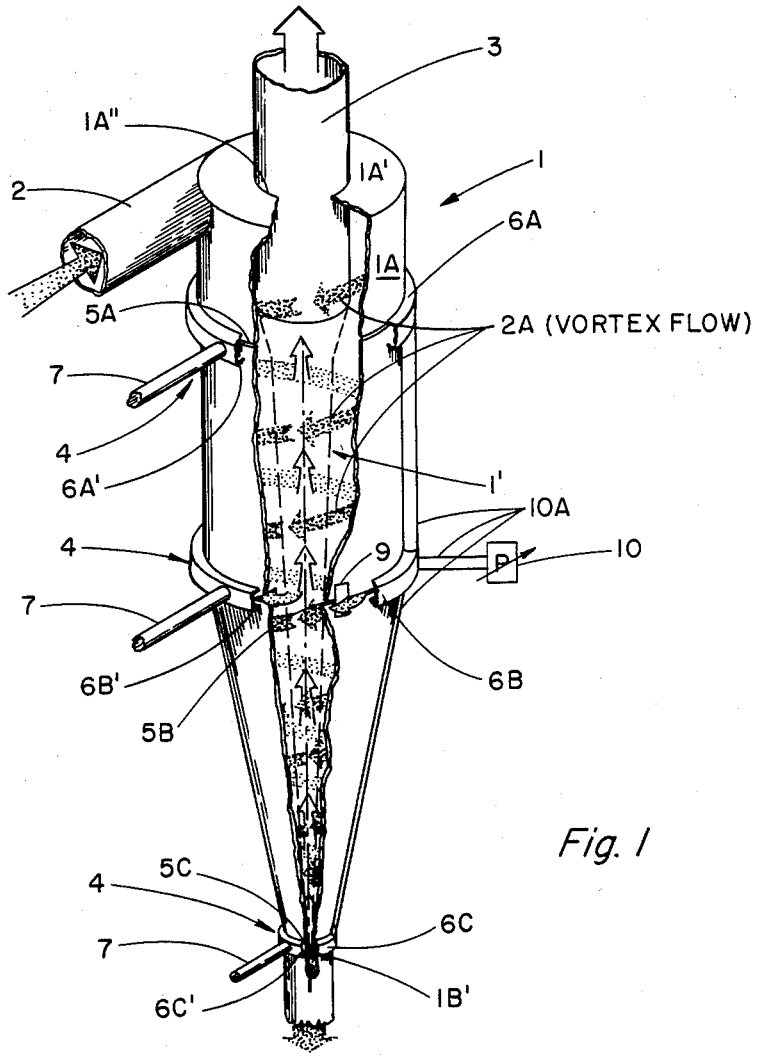
FIG. 1, the sole FIGURE of the drawing, is a schematic perspective view, partly in cross-section, of a cyclone separator having primary fluid inlet and outlet ducts and a particulate collector duct connected to the lower end of the separator. The illustrated separator is a type adapted for receiving very high pressure fluid at its primary fluid inlet in order to develop sufficient centrifugal forces in the separator to extract from the fluid very fine particulate material ranging in size from one to 20 microns. According to the present invention, the illustrated separator is provided with a plurality of spaced boundary layer turbulence control means at predetermined critical locations in order to prevent particulate material from inducing turbulencce at those locations in the laminar vortex fluid flow through the separator.

FIG. 1 illustrates a cyclone separator 1 constructed according to the invention for separating fluid from particulate material entrained therein. The hollow body 1' of the separator includes wall means that may be made of steel or any other suitable conventional material that is effective to direct the flow of high pressure fluids through the vortex flow path that is established in it. In this form of the invention the body wall means are configured to define a generally cylindrical section 1A and a frusto-conical section 1B. These two sections of the separator body may be formed in any conventional manner, such as by appropriately rolling steel sheet stock to form the tubular configurations illustrated and then welding the two sections together. An appropriate end cap 1A' is similarly sealed over the upper end of the generally cylindrical hollow section 1A. The truncated end 1B' of the frusto-conical section 1B is left open to discharge particulate material from the separator through a suitable conventional duct means, to an associated particulate collector (not shown). To enable a stream of fluid to be introduced tangentially into the upper end of the hollow body of the separator, a fluid flow inlet means 2 is provided and, in the illustrated form of the invention, comprises a steel tube welded around an aperture (not shown) in the wall means defining the upper portion of the hollow generally cylindrical section 1A. A primary fluid flow outlet means 3, in the form of another steel duct is welded to the perimeter of an aperture 1A" to secure it in operating position as shown in FIG. 1 with the inner or lower end of the duct 3 positioned around the longitudinal axis of the separator 1. Duct 3 is connected to receive and discharge relatively cleansed fluid from the area near the center upper portion of the hollow body 1' of the separator.

Those skilled in the cyclone separator art will recognize that the general features of the cyclone separator described thus far are effective, responsive to the introduction of a flow of fluid under pressure into the inlet means 2, to direct the fluid into a stream that forms a vortex flow extending from the upper end of generally cylindrical section 1A to the lower end of the frusto-conical section 1B, whereby particulate material entrained in the vortex fluid flow will be driven by centrifugal force toward the inner walls of the hollow body 1'. Accordingly, the cyclone separator 1 and associated fluid flow inlet means 2 operating in combination with the primary fluid flow outlet means 3 are effective, in combination with an introduced stream of fluid under pressure through the inlet means 2, to operate as a conventional means for generating a vortical flow of fluid within the hollow body 1'. In practicing alternative forms of the invention, it will be recognized that other means for generating a vortex flow of fluid, such as the provision of either a fan, or fixed flow directing blades, within the hollow body 1' of the separator may be employed without departing from the teaching of the present invention. However, with the characteristic features of the present invention which will be described below, it has been found that such auxiliary means for generating a vortex flow in the separator are not necessary in order to significantly improve the separating capabilities and efficiency of the separator 1.

According to the characterizing feature of the present invention, the cyclone separator 1 is improved by including boundary layer turbulence control means 4 that are operable, as will be explained in greater detail below, to substantially eliminate radially inward movement of particulate material in the vortex flow (designated by the call out numerals 2A) of the fluid passing through the separator 1. In the preferred embodiment of the invention illustrated here, the boundary layer turbulence control means 4 comprises a suitable means defining a plurality of passageways 5A, 5B and 5C, that each extend respectively from the interior of the hollow body 1' at critical selected areas of the body to the exterior thereof. In addition, channel means 6A, 6B and 6C, which in this embodiment of the invention each comprises a generally U-shaped channel, as shown in cross-section 6A', 6B' and 6C' in the drawing, that is mounted, respectively, over the passageways 5A–C and are effective to direct fluid and any densely entrained particulate material therein from the passageways to a fluid transfer system 7 that may take any suitable conventional form (not shown in complete detail) outside of the hollow body 1'. As seen in the drawing, in the illustrated form of the invention the means defining the passageways 5A–C each comprises a pair of spaced, generally parallel walls that define the respective slits (which are also designated herein by the call-outs 5A, 5B and 5C) and extend through the wall means defining the hollow body 1'.

In order to enable the slits 5A–5C to perform the desired boundary layer turbulence control function of the invention, without either bleeding excessive fluid from the vortex fluid flow or requiring the introduction of undue amounts of fluid into that vortex flow, each of the slits are made to have a width, as measured between their respective parallel walls, in the range of one to five mils, and each of the slits is made to extend for at least 180° around the circumference of the hollow body 1'. In the preferred embodiment each of the slits 5A–5C actually extends essentially 360° around the circumference of the body 1' with only limited areas thereof, such as the areas covered by the support straps (9) welded between the cylindrical section 1A and the frusto-conical section 1B, forming a discontinuity in the slits. As the mode of operation of the boundary layer turbulence control means of the invention becomes better understood, it will be recognized that many other configurations of the means defining passageways 5A–5C may be utilized in practicing the invention.

The boundary layer turbulence control means 4 further comprises a suitable fluid pressure varying means 10 that is connected by any suitable conventional duct means, such as the illustrated metal tubes 10A to communicate in operating relationship with the respective channel means 6A, 6B and 6C for directing fluid either to or from the passageways 5A–5C responsive to variations in fluid pressure in the channel means 6A–6C, relative to the fluid pressure established in the vortex flow 2A and 2B, as such variations in pressure are determined by selected predetermined operation of said fluid pressure varying means 10.

Although the fluid pressure varying means 10 illustrated in FIG. 1 is simply shown schematically as a variable pressure source, it should be understood that it may comprise either a pump for developing a negative, or suction, pressure in the passageways 5A–5C, The channels GA–C, and interconnecting ducts 10A, or it may be a fan or other suitable conventional means for developing a positive pressure in those passageways, channels, and ducts relative to the pressure of the vortex flow fluid within the hollow housing 1'. To practice the invention with the pressure varying means 10 establishing either a positive or a negative pressure in the passageways 5A–5C relative to the pressure of fluid in the vortex flow through hollow housing 1', it should be understood that the boundary layer turbulence control means must be made operable to remove fluid with densely entrained particulate material, at a predetermined fluid pressure, from a plurality of selected critical areas at spaced loci along the vortex flow path through the separator 1, in order to prevent the thus removed particulate material from inducing turbulence in the boundary layer of the vortex flow at those selected areas.

It has been found that there are certain critical areas of a cyclone separator where particulate material is most likely to induce turbulence in the boundary layer of the vortex flow through the separator. Those critical areas comprise the plurality of selected areas from which densely entrained particulate material and fluid are removed, as shown in the drawing, in the illustrated preferred embodiment of the invention. More specifically, those selected areas include the areas of surface irregularity on the wall means defining the interior of hollow body 1' immediately adjacent to the perimeters of the axial extremities of the frusto-conical section 1B, as defined respectively by the walls of slits 5B and 5C. In addition to those critical selected areas of surface irregularity, the selected areas for location of the passageway means 5A–5C of the boundary layer turbulence control means of the invention further include a peripherial band of predetermined axial length around the generally cylindrical section 1A, which band is spaced in the range of 25% to 35% of the length of that section from the fluid flow inlet means 2. As seen in FIG. 1, the passageway means 5A is positioned in a band, defined by the walls of the U-shaped channel 6A that is about a quarter or 25% of the length of the cylindrical section 1A from the inlet duct 2. It has been found that particulate material becomes undesirably densely entrained in the boundary layer of the vortex flow of fluid through the separator within this critical band that is 25 to 35 percent of the length of section 1A from inlet 2, and that encompasses the area of the cylindrical body section after which several initial turns of the primary vortex flow path have been made. If such severly built-up densely entrained particulate material is not removed from the boundary layer in that critical band, the entrained particulate material has been found to induce turbulence in the boundary layer of the vortex flow. Such induced turbulence will cause particulate material to be reentrained in the primary vortex flow, because the turbulence forces the particulate material to move radially inward where it may be drawn by the strong gradient forces at the tail end of the vortical flow path, thus contaminting the discharge vortex flow leaving the separator 1 through the primary fluid outlet means 3.

From the foregoing description of the preferred embodiment of the invention those skilled in the use of cyclone separators should be able to successfully practice the invention; however, in order to provide further explanation of the operation of more specialized preferred embodiments of the invention, continued reference will be made to FIG. 1 of the drawing to describe how the separator 1 can be made and operated to provide boundary layer turbulence control for the separator; with the variable pressure means 10 operating in a suction mode to afford regulated extraction of a predetermined portion of fluid from the vortex flow 2A through the separator, along with the controlled extraction of densely entrained particulate from that flow. In such an embodiment, the boundary layer turbulence control means 4 is made to include a suction pump 10, such as a suitable conventional fan that is operatively connected to the channel means 10A and is effective to maintain a predetermined negative pressure on the fluid in the vortex fluid flow 2A, as well as on the densely entrained particulate material therein, as that fluid and entrained material encounters the passageway means 5A–5C. According to the invention, that predetermined negative pressure is maintained significantly lower than the pressure of the fluid in the vortex flow at those extraction areas in order to cause a predetermined portion of the fluid and densely entrained particulate material to be extracted from the vortex flow and drawn through said passageway means and the connected channel means 10A to the suction pump 10.

In such a preferred embodiment of the invention, the predetermined pressure maintained in the respective passageway means 5A–5C by the suction pump 10 is in the range of 70% to 90% of the pressure of the fluid in the primary vortex fluid flow 2A adjacent the separator wall as the fluid passes through the separator 1. Because all of the duct means 10A and each of the passageways 5A–5C are connected in common communication by the respective U-shaped channel means 6A–6C, the suction pump 10 is capable of maintaining essentially the same predetermined pressure on the vortically flowing fluid and densely entrained particulate material at their points of extraction through each of the passageways or slits 5A–5C. Such an arrangement and mode of operation is effective to maintain an essentially laminar flow in the boundary layer of the vortex fluid flow 2A by preventing the excessive build-up of particulate material in the separator 1 at the selected critical areas where the passageway means 5A–5C are located according to the invention.

In using such a preferred embodiment of the invention to purify a gas having entrained particulate material containing a substantial portion of particles ranging in size from 1 to 10 microns it has been found that the suction pump 10 should be operated to maintain a suction pressure on each of the passageway means or slits 5A–5C that is sufficient to extract between 0.5 and 2.5 percent of the total vortex fluid flow and associated densely entrained particulate material from the hollow housing 1' in order to maintain essentially laminar flow of the boundary layer of the vortex flow. This desirable laminar flow enables the cyclone separator 1 to remove enough of the particulate ranging in size from 1 to 10 microns so that only 1% or 2% of the originally entrained particulate near the 10 micron size, and less than 30% of the originally entrained particulate material near the 1 micron size, remains in the vortex flow immediately adjacent the primary fluid outlet means 3. By way of comparison, in prior art high pressure cyclone separators that do not incorporate a boundary layer turbulence control means, such as those disclosed herein, we have found that it is generally only possible to effect the removal of about 50% of the originally entrained particulate material ranging in size from 1 to 10 microns by the passage of such material in a gas through the separator. Moreoever, most of the extracted particles in that range are those nearer the 10 micron size, while the majority of particulate near 1 micron size remains entrained in the vortical flow of fluid.

To further explain the operation of the invention, reference is again made to FIG. 1, to consider a mode wherein the variable pressure means 10 is a suitable positive pressure pump that is operatively connected to the passageway means 5A–5C by the channel means 6A–6B and duct means 10A. The pump 10 is operated to maintain a predetermined positive pressure on the fluid and densely entrained particulate material immediately adjacent to the passageways 5A–5C, which pressure is made significantly higher than the pressure of the fluid in the vortex flow 2A within the hollow housing 1', in order to cause a predetermined amount of fluid to enter the vortex flow. The introduced higher pressure fluid removes the densely entrained material from the preselected areas adjacent to the passageway means 5A–5C. In this preferred alternative embodiment of the invention operating with a pressure pump 10, the predetermined pressure maintained at the passageway means, or slits, 5A–5C is in the range of 110% to 130% of the pressure of the fluid in the high pressure vortex flow 2A, near the walls of separator 1. It will be understood that with the fluid pressurizing pump 10, a supply of suitably purified fluid, i.e. fluid without substantial particulate matter entrained therein, must be made available from a suitable source (not shown), so that such a relatively pure fluid can be directed from the fluid pressure varying means or pump 10 through the duct means 10A to the slits 5A–5C and thence into the boundary layer of the vortex flow. Such suitably purified fluid should be compatible with the fluid in the vortex flow and could be extracted from the clean fluid existing through the primary fluid outlet means 3.

To prevent the introduction of such auxiliary fluid into the boundary layer from, itself, inducing an undesirable degree of turbulence in the boundary layer, the pure fluid is preferably introduced through the slits 5A–5C at an angle less than 5 degrees to the path of flow of fluid in the vortex flow. Further, in order to provide an effective volume of fluid under pressure to prevent the undesirable build-up of particulate matter adjacent to the passageways 5A–5C, the pressure pump 10 is operable in this preferred embodiment of the invention to increase total volume of fluid in the vortex flow 2A through hollow housing 1' in the range of 0.5% to 2.5% relative to the volume of vortex fluid flow immediately adjacent to said fluid flow inlet means 2.

From the foregoing description of the invention it will be apparent that various further modifications and alternative forms of the invention may be developed and used in practicing it. For example, rather than using slits to form the passageway means 5A–5C, as shown in the preferred embodiment of the invention, alternative forms of the invention may use various other conventional means for defining such passageways. Without intending to limit the foregoing description of the invention, it should be understood that either many small apertures, or a few relatively large apertures, can be used, disposed respectively in a variety of predetermined patterns within the above designated selected critical areas around the perimeter of the wall means defining hollow housing 1' of the separator 1. Similarly, many different types of suitable channel means 6A–6C and duct means 10A can be provided, including well known fabricating means for making such channel and duct means as integral parts of the separator 1. Accordingly, it is our intention to define the true spirit and scope of the invention in the following claims.

We claim:

1. In a cyclone separator for separating fluid from particulate material entrained therein, comprising:

a hollow body including wall means defining a generally cylindrical section and an adjacent frusto-conical section;

fluid flow inlet means and primary fluid outlet means for directing, respectively, the flow of a fluid into and out of said hollow body, and further including vortex generating means for generating a vortex flow of fluid within said hollow body, whereby the fluid is cleansed by having entrained particulate material separated from the fluid as it flows through the vortex to the primary fluid outlet means;

wherein the improvement comprises said cyclone separator having a boundary layer turbulence control means for substantially reducing radially inward movement of particulate material in the vortex flow of said fluid, said boundary layer turbulence control means being operable to remove from said hollow body fluid with densely entrained particulate material, at a predetermined fluid pressure, from a plurality of selected critical areas at vertically spaced loci along the vortex flow path, whereby said removed particulate material is prevented from inducing turbulence in the boundary layer of the vortex flow at said selected areas, said plurality of selected areas from which densely entrained particulate material and fluid are removed including both of the areas of surface irregularity on said wall means immediately adjacent to the perimeters of the axial extremeties of said frusto-conical section.

2. The invention as defined in claim 1, wherein the improvement further comprises said selected areas further including a peripheral band of predetermined axial length around said generally cylindrical section, said band being spaced in the range of 25% to 35% of the length of said cylindrical section from the fluid flow inlet means.

3. The invention as defined in claim 1, wherein the improvement further comprises said boundary layer turbulence control means further comprising fluid pressure varying means, and means defining a plurality of passageways extending respectively from the interior of said hollow body at said selected areas thereof to the exterior of said body, and channel means for directing fluid to or from said passageways responsive to variations in fluid pressure in said channel means relative to the fluid pressure in said vortex flow as determined by selected variations in the fluid pressure in said passageways caused by predetermined operation of said fluid pressure varying means.

4. The invention as defined in claim 3, wherein the improvement further comprises said boundary layer turbulence control means including a pump operatively connected to said channel means and being in effective communication with said passageways for maintaining said predetermined pressure in the fluid and densely entrained particulate material adjacent said passageways significantly higher than the pressure of the fluid in said vortex flow, thereby to cause a predetermined volume of relatively pure fluid to be injected into the vortex flow and densely entrained particulate material, through said passageways and said channel means from the pressure pump.

5. The invention as defined in claim 4, wherein the improvement further comprises said predetermined pressure being in the range of 110% to 130% of the pressure of the fluid in said vortex fluid flow adjacent the separator wall.

6. The invention as defined in claim 3, wherein the improvement further comprises said fluid pressure varying means including a pump operatively connected to duct means that communicate with said channel means and are in effective communication with said passageways for maintaining said predetermined pressure on the fluid and densely entrained particulate material immediately adjacent to said passageways significantly lower than the pressure of the fluid in said vortex flow adjacent the wall of the separator, thereby to cause a predetermined portion of the fluid and densely entrained particulate material to be extracted from the vortex flow and drawn through said passageways into said channel means.

7. The invention as defined in claim 6, wherein the improvement further comprises said predetermined pressure being in the range of 70% to 90% of the pressure of the fluid in said vortex flow.

8. The invention as defined in claim 6, wherein the improvement further comprises all of said channel means, duct means, and each of said passageways being connected in common thereby to enable said pump to maintain essentially the same predetermined pressure on the fluid and densely entrained particulate material as it is extracted from said passageways.

9. The invention as defined in claim 8, wherein the improvement further comprises said fluid being a gas, said entrained particulate material containing a substantial portion of particulate ranging in size from 1 to 10 microns adjacent to said fluid inlet means, and said pump being operable to maintain a suction pressure on each of said passageways sufficient to extract between 0.5% and 2.5% of the total vortex flow and associated densely entrained particulate material from the vortex flow, thereby to maintain essentially laminar flow in the bounary layer of the vortex and to enable the cyclone separator to remove from said vortex flow enough of the particulate ranging in size from 1 to 10 microns so that only between 1% and 2% of the originally entrained particulate near the 10 micron size and less than 30% of the originally entrained particulate material near the 1 micron size remain in the vortex flow immediately adjacent to said primary outlet means.

10. The invention as defined in claim 3, wherein the improvement further comprises each of said means defining said passageways comprising a pair of spaced, generally parallel walls, defining a slit through the wall means of said body, each of said slits being in the range of 5 to 10 mils wide and extending for at least 180° of the circumference of said body.

11. The invention as defined in claim 10, wherein the improvement further comprises each of said slits extending for essentially 360° of the circumference of said body, and wherein each of said channel means comprising a generally U-shaped channel mounted respectively over one of said slits to direct the fluid and densely entrained particulate extracted from the vortex flow and passed through the slits to a fluid transfer system outside of said body.

12. The invention as defined in claim 10, wherein the improvement further comprises each of said slits being essentially 360° of the circumference of said body, and wherein each of said channel means comprises a generally U-shaped channel mounted respectively over one of said slits to direct the fluid from said fluid pressure varying means through said slits into the boundary layer of said vortex flow at an angle less than 5 degrees to the path of flow of fluid in the vortex, in order to prevent the introduced fluid from inducing turbulence in the boundary layer.

13. The invention as defined in claim 12, wherein the improvement further comprises said fluid pressure varying means is operable to increase the total volume in said vortex in the range of 0.5% to 2.5% relative to the volume of vortex fluid flow immediately adjacent to said fluid flow inlet means.

14. The invention as defined in claim 13, wherein the improvement further comprises said fluid pressure varying means being effective to supply fluid to the channel means from an essentially particulate-free fluid source.

* * * * *